US007391414B2

(12) United States Patent
Wakimoto et al.

(10) Patent No.: US 7,391,414 B2
(45) Date of Patent: Jun. 24, 2008

(54) ELECTRO-OPTICAL DEVICE, CONTROLLER FOR CONTROLLING THE ELECTRO-OPTICAL DEVICE, METHOD FOR CONTROLLING THE ELECTRO-OPTICAL DEVICE, AND ELECTRONIC DEVICE

(75) Inventors: Shingo Wakimoto, Nagano (JP); Takashi Otome, Nagano (JP); Kenichi Tajiri, Nagano (JP)

(73) Assignee: Seiko Epson Corporation (JP)

( * ) Notice: Subject to any disclaimer, the term of this patent is extended or adjusted under 35 U.S.C. 154(b) by 617 days.

(21) Appl. No.: 11/074,363

(22) Filed: Mar. 7, 2005

(65) Prior Publication Data

US 2005/0206638 A1 Sep. 22, 2005

(30) Foreign Application Priority Data

Mar. 19, 2004 (JP) ..... 2004-081512

(51) Int. Cl.
*G09G 3/36* (2006.01)
*G09G 5/00* (2006.01)

(52) U.S. Cl. ..... 345/209; 345/96

(58) Field of Classification Search ..... 345/94, 345/96, 208, 209, 211–213
See application file for complete search history.

(56) References Cited

U.S. PATENT DOCUMENTS

2003/0043105 A1* 3/2003 Hirakata ..... 345/96

FOREIGN PATENT DOCUMENTS

JP 09-269476 10/1997
JP 2003-263134 9/2003

* cited by examiner

*Primary Examiner*—Alexander Eisen
*Assistant Examiner*—Kenneth B Lee
(74) *Attorney, Agent, or Firm*—Harness, Dickey & Pierce, P.L.C.

(57) ABSTRACT

A controller includes a register storing a group of parameters including a driving-control parameter for controlling a data line driving circuit and a scanning line driving circuit, a parameter controller for updating values of the group of parameters stored in the register and for initializing the values of the group of parameters stored in the register when a reset signal RES is input, and a driving controller for controlling a data line driving circuit and a scanning line driving circuit in accordance with the driving-control parameter stored in the register. The driving controller controls the data line driving circuit and the scanning line driving circuit such that turn-off voltage is applied to a plurality of pixels after the parameter controller updates the values of the group of parameters by the reset signal.

14 Claims, 8 Drawing Sheets

ELECTRO-OPTICAL DEVICE, CONTROLLER FOR CONTROLLING THE ELECTRO-OPTICAL DEVICE, METHOD FOR CONTROLLING THE ELECTRO-OPTICAL DEVICE, AND ELECTRONIC DEVICE

RELATED APPLICATIONS

This application claims priority to Japanese Patent Application No. 2004-081512 filed Mar. 19, 2004 which is hereby expressly incorporated by reference herein in its entirety.

BACKGROUND

1. Technical Field

The present invention relates to a technique to display images using electro-optical material such as liquid crystal.

2. Related Art

In electro-optical devices such as liquid crystal devices, a plurality of pixels aligned so as to correspond to the intersections of a plurality of scanning lines and a plurality of data lines is driven by driving circuits, such as scanning line driving circuits and data line driving circuits. A technique applicable to the electro-optical devices is disclosed in Japanese Unexamined Patent Application Publication No. 2003-263134 (see Paragraph 0043 and FIG. 2). In this technique, a driving circuit is controlled in accordance with various parameters written in a register. The parameters stored in the register are changed as necessary in accordance with a command input from an external device, such as a CPU in an electronic device in which the liquid crystal device is incorporated. With this type of electro-optical device, display may be interrupted due to a sporadic incident, e.g., when a battery is removed from the electronic device. In this case, a command to halt display is input from the external device and thus display is halted after the parameters have been initialized in accordance with the command.

In a liquid crystal device using liquid crystal as the electro-optical material, electric charge may remain in pixels, namely, liquid crystal capacitors, after halting display. If remaining electric charge keeps applying direct voltage to the liquid crystal, the orientation of the liquid crystals is changed to be different from the predetermined orientation, resulting in degradation in display quality. To address this problem, in a technique disclosed in Japanese Unexamined Patent Application Publication No. Hei 9-269476 (see Paragraph 0018 and FIG. 3), turn-off voltage is applied to all pixels after halting display (referred to as power-off-sequence process hereinbelow). With this technique, since electric charge stored in the pixels is discharged before halting display, degradation in liquid crystal characteristics due to application of direct voltage is suppressed.

Preferably, in the liquid crystal display disclosed in Japanese Unexamined Patent Application Publication No. 2003-263134, when a command to halt display is issued, a power-off-sequence process is performed and then the parameters are initialized, thereby halting display. With this liquid crystal display having the aforementioned construction, however, after completion of the power-off-sequence process, the parameters are initialized. Therefore, if a command to change the parameters is input from the external device during the power-off-sequence process to change the parameters, the parameters are initialized after the power-off-sequence process and thus the command is not reflected on the liquid crystal display. Specifically, a command to halt display is often input when an emergency occurs and other commands tend to be input one after another to solve the emergency. This may lead to a serious problem in the liquid crystal device having the aforementioned construction since the commands cannot be accepted during the entire power-off-sequence process. The present invention is designed to solve the aforementioned problems and it is an object of the present invention to provide a mechanism to accept a command input from an external device in an electro-optical device in which a power-off sequence process is performed in advance of halting display.

SUMMARY

To solve the aforementioned problems, in the controller according to a first aspect of the present invention, when the reset signal to halt display is input, the values of the group of parameters stored in the storage unit are initialized and subsequently the power-off-sequence process is performed. With this construction, the values of the group of parameters are initialized prior to the power-off-sequence process. Therefore, even when a command to change the group of parameters is input from an external device during the power-off-sequence process, the input command is reflected on the group of parameters.

More specifically, the controller according to the first aspect of the present invention controls an electro-optical device having a plurality of pixels aligned so as to correspond to each of the intersections of a plurality of scanning lines and a plurality of data lines, and a driving circuit, such as a scanning line driving circuit and a data line driving circuit, that performs sequential vertical scanning of the selected plurality of scanning lines and applying data voltage to the pixels corresponding to the scanning lines in accordance with display information. The controller includes a storage unit that stores a group of parameters including a driving-control parameter that controls the operation of the driving circuit; an input unit that allows a command and a reset signal to be input, the command instructing a change in the group of parameters, the reset signal instructing display to halt; a parameter controller that updates values of the group of parameters stored in the storage unit in accordance with the command when the command is input to the input unit and that initializes the values of the group of parameters stored in the storage unit when the reset signal is input to the input unit; and a driving controller that controls the driving circuit in accordance with the driving-control parameter stored in the storage unit, the driving controller controlling the driving circuit such that turn-off voltage is applied to the plurality of pixels after the parameter controller updates the values of the group of parameters by the input of the reset signal. With this structure, the power-off-sequence process is performed after initializing the values of the group of parameters by the input of the reset signal. Therefore, even when a command to change the group of parameters is input from an external device during the power-off-sequence process, the input command is reflected on the group of parameters.

The electro-optical device may be used for a display in various types of electronic devices. Therefore, there are cases where the initial values stored in the storage unit can constitute optimum driving conditions for the electronic device, whereas there are case where the initial values cannot constitute optimum conditions for the electronic device since the electro-optical device is applied to the electronic device that is a different type than that of an electronic device for which the initial values are intended. In the latter case, after initializing the values of the group of parameters, these parameters need to be changed to selected parameters specifically for the electronic device. In the construction where specific values are used for the driving-control parameter, when the display is halted, the driving-control parameter is initialized. As a result, the following power-off-sequence process cannot be performed under optimum driving conditions. To solve this problem, a controller according to a second aspect of the present invention controls an electro-optical device including a plurality of pixels aligned so as to correspond to each of the intersections of a plurality of scanning lines and a plurality of data lines, and a driving circuit that performs sequential vertical scanning of the selected plurality of scanning lines and applying data voltage to the pixels corresponding to the scanning lines in accordance with display information. The controller includes a storage unit that stores a group of parameters including a driving-control parameter that controls the operation of the driving circuit; an input unit that allows a command and a reset signal to be input, the command instructing a change in the group of parameters, the reset signal instructing display to halt; a parameter controller that updates values of the group of parameters stored in the storage unit in accordance with the command when the command is input to the input unit and that initializes the values of the group of parameters stored in the storage unit except the driving-control parameter when the reset signal is input to the input unit; and a driving controller that controls the driving circuit in accordance with the driving-control parameter stored in the storage unit such that turn-off voltage is applied to the plurality of pixels after the parameter controller updates the values of the group of parameters by the input of the reset signal. With this construction, when the reset signal is input, the group of parameters except the driving-control parameter regarding driving the electro-optical device is updated and the values of the driving-control parameter are maintained to be the specific values. Thus, the following power-off-sequence process is performed under optimum conditions.

The driving controller of the first and second aspects of the present invention controls the driving circuit such that voltage applied to a first group of pixels out of the plurality of pixels has opposite polarity from the polarity of voltage applied to a second group of pixels that are different from the pixels in the first group, and the polarity of voltage applied to the pixels is alternately reversed for every predetermined period. For example, the polarity of applied voltage is inverted for every row of pixels corresponding to each scanning line (H-line inversion). In this structure, when the reset signal is input during vertical scanning, vertical scanning being performed at the time of the input of the reset signal is interrupted and new vertical scanning is performed as the power-off-sequence process. However, if the same vertical scanning as that performed in normal driving operation is performed after the input of the reset signal, voltage with same polarity as that has been applied to pixels corresponding to scanning lines that should have been selected after the interruption of the vertical scanning is applied to the pixels (refer to FIG. 7). In a case where voltage applied to the pixels in the power-off-sequence process has the same polarity as that of voltage has been applied to the pixels immediately before, if turn-off voltage is applied to the pixels, electrical charge stored in the pixels cannot be sufficiently discharged. Therefore, according to the first and second aspects of the present invention, preferably, the driving controller controls the driving circuit such that when the reset signal is input to the input unit, vertical scanning being performed at the time of the input of the reset signal is interrupted and new vertical scanning is started from the first scanning line, and in the new vertical scanning, turn-off voltage with opposite polarity from voltage that has been applied to pixels corresponding to scanning lines selected before the interruption during the interrupted vertical scanning is applied to the pixels, while turn-off voltage with opposite polarity from voltage that has been applied to pixels in vertical scanning preceding the interrupted vertical scanning, the pixels corresponding to scanning lines that should have been selected after the interruption in the interrupted vertical scanning, is applied to the pixels (refer to FIG. 8). With this structure, even if vertical scanning is interrupted by the input of the reset signal, voltage applied to the pixels in the power-off-sequence process has opposite polarity from that of voltage has been applied to the pixels immediately before. Accordingly, electric charge stored in the pixels can be sufficiently discharged and thus degradation in electro-optical material caused by the application of direct voltage is suppressed.

A controller according to a third aspect of the present invention controls an electro-optical device including a plurality of pixels aligned so as to correspond to each of the intersections of a plurality of scanning lines and a plurality of data lines, and a driving circuit that performs sequential vertical scanning of the selected plurality of scanning lines and applying data voltage to the pixels corresponding to the scanning lines in accordance with display information. The controller includes an input unit that inputs a reset signal, the reset signal instructing display to halt; and a driving controller that controls the driving circuit to apply voltage to a first group of pixels out of the plurality of pixels has opposite polarity from the polarity of voltage applied to a second group of pixels that are different from the pixels in the first group, and the polarity of voltage applied to the pixels is alternately reversed for every predetermined period, and such that when the reset signal is input to the input unit, vertical scanning being performed at the time of the input of the reset signal is interrupted and new vertical scanning is started from the first scanning line, and in the new vertical scanning, turn-off voltage with opposite polarity from voltage that has been applied to pixels corresponding to scanning lines selected before the interruption during the interrupted vertical scanning is applied to the pixels, while turn-off voltage with opposite polarity from voltage that has been applied to pixels, which correspond to scanning lines that should have been selected after the interruption in the interrupted vertical scanning, in vertical scanning preceding the interrupted vertical scanning is applied to the pixels. With this structure, voltage applied to the pixels in the power-off-sequence process has opposite polarity from that of voltage has been applied to the pixels immediately before. Accordingly, electric charge stored in the pixels can be sufficiently discharged and thus degradation in electro-optical material is suppressed.

An electro-optical device according to a fourth aspect of the present invention has features as set forth in the first to third aspects of the present invention. More specifically, the electro-optical device includes a plurality of pixels aligned so as to correspond to each of the intersections of a plurality of scanning lines and a plurality of data lines; a driving circuit that sequentially performs vertical scanning of the plurality of scanning lines and applying data voltage to pixels corresponding to the scanning lines in accordance with display information; and a controller as set forth in the first to third aspects of the present invention. With this structure, the same operation and effects as those of the controller of the first to third aspects of the present invention are achieved. The electro-optical device is used as a display in various electronic devices such as cellular phones or personal computers, for example. Furthermore, according to a fifth aspect of the preset invention, a method that controls an electro-optical device includes the steps of updating values of a group of parameters stored in a storage unit when a command that controls the operation of the driving circuit and changing the group of parameters including a driving-control parameter is input to the input unit in accordance with the command; initializing the values of the group of parameters stored in the storage unit except the driving-control parameter when the reset signal that instructs display to halt is input; and controlling the driving circuit in accordance with the driving-control parameter stored in the storage unit and controlling the driving circuit such that turn-off voltage is applied to the plurality of pixels after the values of the group of parameters are updated by the input of the reset signal.

According to a sixth aspect of the present invention, a method that controls an electro-optical device has features recited in the first to third aspects of the present invention, as described above. More specifically, the method that controls an electro-optical device has the steps of: updating values of a group of parameters stored in the storage unit when a command that controls the operation of the driving circuit and changing a group of parameters including a driving-control parameter is input to the input unit in accordance with the command, and initializing the values of the group of parameters stored in the storage unit when the reset signal that instructs display to halt is input; and controlling the driving circuit in accordance with the driving-control parameter stored in the storage unit such that turn-off voltage is applied to the plurality of pixels after the values of the group of parameters are updated by the input of the reset signal.

According to a seventh aspect of the present invention, a method that controls an electro-optical device includes a step of controlling the driving circuit such that voltage applied to a first group of pixels out of the plurality of pixels has opposite polarity from the polarity of voltage applied to a second group of pixels that are different from the pixels in the first group, and the polarity of voltage applied to the pixels is alternately reversed for every predetermined period and such that when the reset signal that instructs display to halt is input to the input unit, vertical scanning being performed at the time of the input of the reset signal is interrupted and new vertical scanning is started from the first scanning line, and in the new vertical scanning, turn-off voltage with opposite polarity from voltage that has been applied to pixels corresponding to scanning lines selected before the interruption during the interrupted vertical scanning is applied to the pixels, while turn-off voltage with opposite polarity from voltage that has been applied to pixels in vertical scanning preceding the interrupted vertical scanning, the pixels corresponding to scanning lines that should have been selected after the interruption in the interrupted vertical scanning, is applied to the pixels.

DETAILED DESCRIPTION

Structure of Liquid Crystal Device

Figure 1:
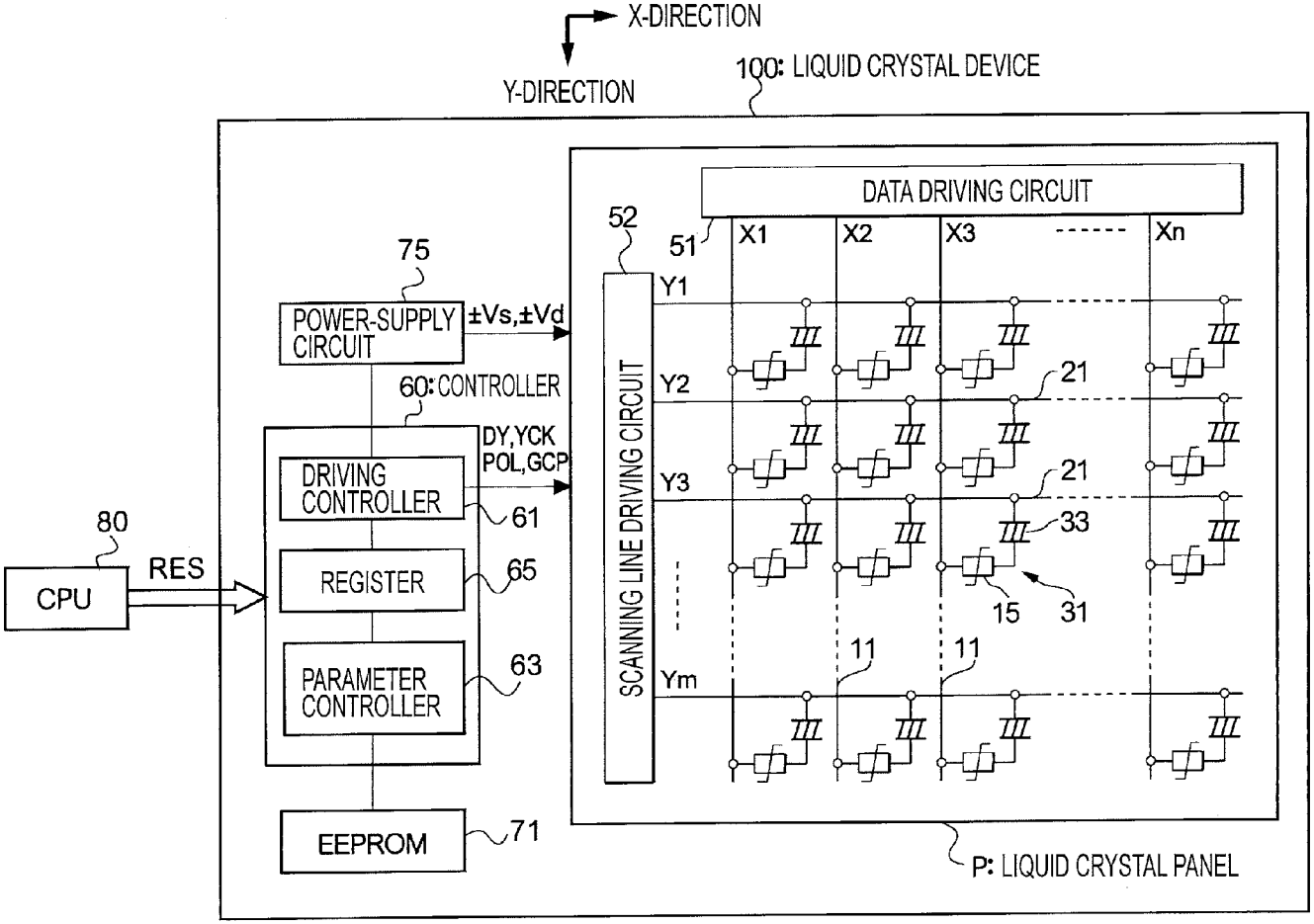
FIG. 1 is a block diagram of the structure of a liquid crystal device according to an embodiment of the present invention.

FIG. 1 is a block diagram of the structure of a liquid crystal device according to an embodiment of the present invention. A liquid crystal device 100 serving as a display is incorporated in an electronic device, such as a cellular phone, and is connected to a central processing unit or CPU 80 for controlling the overall operation of the electronic device. As shown in FIG. 1, the liquid crystal device 100 includes a liquid crystal panel P, a controller 60, and a power-supply circuit 75. The liquid crystal panel P has scanning lines 21 connected to a scanning line driving circuit 52 and data lines 11 connected to a data line driving circuit 51. The scanning lines 21 extend in an X-direction (row direction), whereas the data lines 11 extend in a Y-direction (column direction). The total number of the scanning lines 21 is m-lines, whereas that of the data lines 11 is n-lines (m and n are natural numbers). A pixel 31 is disposed at each intersection of the scanning lines 21 and the data lines 11. m-rows by n-columns of the pixels 31 are arranged in a matrix. As shown in FIG. 1, each pixel 31 includes a thin film diode (TFD) 15 serving as a two-terminal switching device and a liquid crystal capacitor 33 connected to the TFD 15 in series. The liquid crystal panel P operates in a normally white mode, whereby the liquid crystal panel P is white when voltage is not applied.

Figure 2:
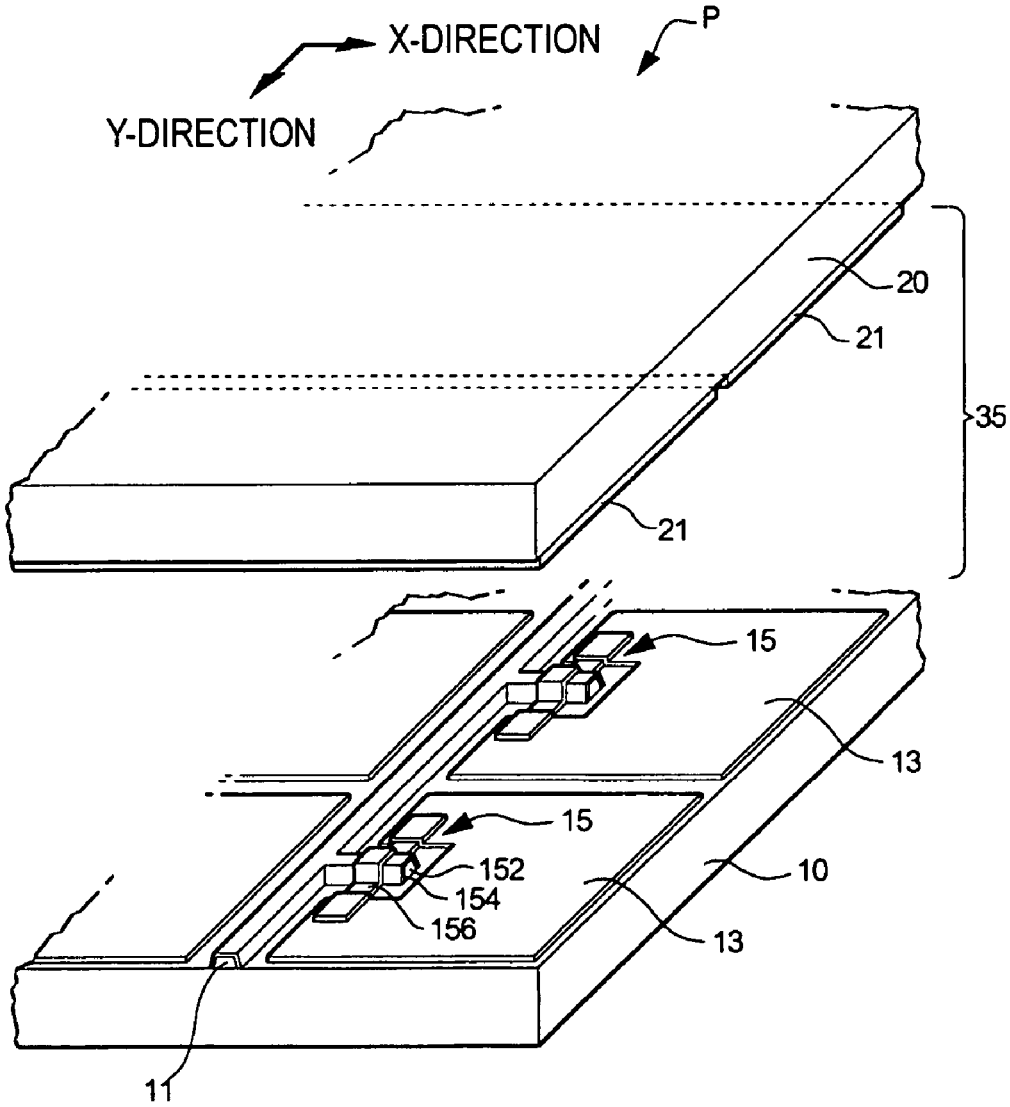
FIG. 2 is a fragmental enlarged perspective view of the liquid crystal device.
Figure 3:
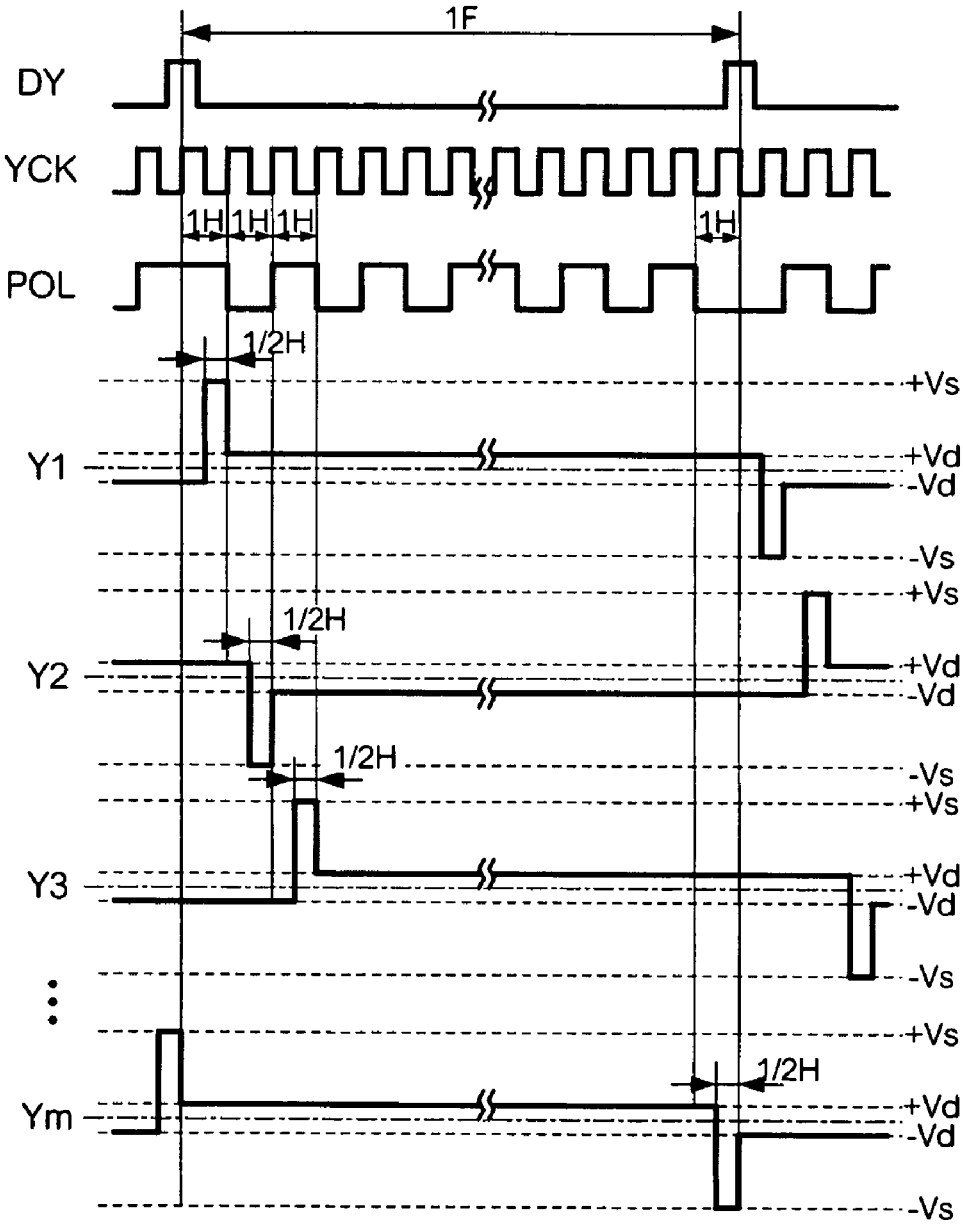
FIG. 3 is a timing chart, describing the operation of a scanning line driving circuit.

FIG. 2 is an enlarged perspective view of the liquid crystal panel P, showing the intersection of the data line 11 and the scanning line 21. As shown in FIG. 2, the liquid crystal panel P includes an element board 10 and a counter board 20, which oppose each other. The element board 10 and the counter board 20 are bonded with a seal (not shown) with a certain space therebetween. A twisted nematic (TN) liquid crystal 35 is confined in the space between the element board 10 and the counter board 20. The data lines 11 are disposed on the surface of the element board 10 opposing the liquid crystal 35. Pixel electrodes 13 having a substantially rectangular shape are disposed on the surface of the element board 10 in a matrix and are connected to the respective data lines 11 through the TFDs 15, which are also disposed on the surface of the element board 10. As shown in FIG. 2, each TFD 15 has a sandwiched-structure in which a first conductor 152 branched off from the data line 11, an insulator 154 obtained through anodic oxidation of the surface of the first conductor 152, and a second conductor 156 connected to the pixel electrode 13 are layered in this order on the element board 10. Therefore, the TFDs 15 each have a diode-switching characteristic with which current-voltage characteristic is linear in both positive and negative directions. The aforementioned scanning lines 21 are disposed on the surface of the counter board 20 opposing the liquid crystal 35. The scanning lines 21 are electrode strips composed of a transparent conductor such as indium tin oxide (ITO) and face a plurality, e.g., n-pieces of pixel electrodes 13, which are aligned in the X-direction on the surface of the element board 10. The liquid crystal capacitor 33, shown in FIG. 3, is composed of the liquid crystal 35 that is disposed between the scanning line 21 and the pixel electrode 13 at the intersection of the data line 11 and the scanning line 21.

The scanning line driving circuit 52 supplies scanning signals Y1, Y2, . . . , and Ym to the first, second, . . . , and the m-th scanning lines 21, respectively. The data line driving circuit 51 supplies data signals X1, X2, . . . and Xn to the first, second, . . . , and the n-th data lines 11, respectively, in accordance with display information (gray scale) of the pixels 31. In the present embodiment, one out of eight shades is selected as the display information of the pixel 31 in response to 3-bits image data. The power-supply circuit 75 generates voltage ±Vs and voltage ±Vd having a voltage level specified by the controller 60. The voltage ±Vs is supplied to the scanning line driving circuit 52 and is used as a selected voltage for a scanning signal Yi (i is an integer satisfying $1 \leqq i \leqq m$). The selected voltage is voltage with which the TFD 15 is conducted despite the presence of voltage for a data signal Xj (j is an integer satisfying $1 \leqq j \leqq n$) to be supplied to the data line 11 when the supplied voltage ±Vs is applied to the scanning line 21. The voltage ±Vd is supplied to the scanning line driving circuit 52 and is used as a non-selected voltage for the scanning signal Yi. The non-scanning voltage is voltage with which the TFD 15 is not conducted despite the presence of the voltage for the data signal Xj to be supplied to the data line 11 when the voltage ±Vd is applied to the scanning line 21. The voltage ±Vd is also supplied to the data line driving circuit 51 for the data signal Xj.

The CPU 80 inputs, to the controller 60 in the liquid crystal device 100, a synchronizing signal for generating various signals such as the scanning signal Yi, commands for specifying the operation of the liquid crystal device 100, and image data for determining the gray scale of each dot constituting an image to be displayed. The commands to be input to the liquid crystal device 100 from the CPU 80 include a command for initiating display operation and a command for changing parameters for the image display operation of the liquid crystal device 100. When an incident where display needs to be halted abruptly occurs, such as when a battery of the electronic device is removed, the CPU 80 inputs a reset signal RES to the controller 60.

The controller 60 controls the operation of the entire liquid crystal device 100. As shown in FIG. 1, the controller 60 includes a register 65 for storing parameters to define the image display operation of the liquid crystal device 100, a driving controller 61 for controlling each element of the liquid crystal device 100 in accordance with the parameters stored in the register 65, and a parameter controller 63 for writing/reading the parameters on/from the register 65. The driving controller 61 and the parameter controller 63 may be operated by a combination of a computating-controller, such as a CPU, and a program or by hardware intended especially for the driving controller 61 and the parameter controller 63. The driving controller 61 generates and outputs various signals to be used for the scanning line driving circuit 52 and the data line driving circuit 51 to drive the pixels 31. More specifically, referring to FIG. 3, the driving controller 61 generates various signals including a start pulse DY, which rises first during each vertical scanning period (1F), a clock signal YCK having a period corresponding to one horizontal scanning period (1H), a polarity-directing signal POL, and a gray-scale-controlling pulse GCP.

The polarity-directing signal POL determines the polarity of the selected voltage to be applied to a scanning line 21 when the scanning line 21 is selected. For example, when the polarity-directing signal POL takes an H-level, positive selected voltage +Vs is selected for the scanning signal Yi. When the polarity-directing signal POL takes an L-level, negative selected voltage −Vs that has negative polarity is selected for the scanning signal Yi. Referring to FIG. 3, the polarity-directing signal POL reverses its logic level every horizontal scanning period in a vertical scanning period. In the sequential vertical scanning periods, the logic level of the polarity-directing signal POL is reversed between horizontal scanning periods in which the same scanning line 21 is selected. The scanning signal Yi generated at the scanning line driving circuit 52 has positive selected voltage +Vs in the latter-half (½H) of a horizontal scanning period during which the i-th scanning line 21 is selected. After the horizontal scanning period for the i-th scanning line 21, the scanning signal Yi has positive non-selected voltage +V, which has the same polarity as that of the selected voltage +Vs for the next previous horizontal scanning period, and the non-selected positive voltage +Vd remains. On the other hand, during a horizontal scanning period during which the (i+1)-th scanning line 21 is selected, the logic level of the polarity-directing signal POL is inverted to be an L-level and thus a scanning signal Yi+1 supplied to the (i+1)-th scanning line 21 has negative selected voltage −Vs in the latter-half of the horizontal scanning period, and after this horizontal scanning period, the scanning signal Yi+1 has negative non-selected voltage −Vd, which has the same polarity as the negative selected voltage −Vs in the next previous horizontal scanning period, and this negative non-selected −Vd remains. That is, the scanning signals Y1 to Ym have alternate positive selected voltage +Vs and negative selected voltage −Vs for every horizontal scanning period in a vertical scanning period during which the first to the m-th scanning lines 21 are selected. The logic level of the polarity-directing signal POL is inverted between the sequential vertical scanning periods. Accordingly, when the selected voltage for the scanning signals Yi for an odd-numbered scanning lines 21 is positive selected voltage +Vs and the selected voltage for the scanning signals Yi for the even-numbered scanning lines 21 is negative selected voltage +Vs in a certain vertical scanning period, the selected voltage for the scanning signal Yi for the odd-numbered scanning lines 21 is negative selected voltage −Vs and the selected voltage for the scanning signal Yi for the even-numbered scanning lines 21 is positive selected voltage +Vs in the next vertical scanning period.

Figure 4:
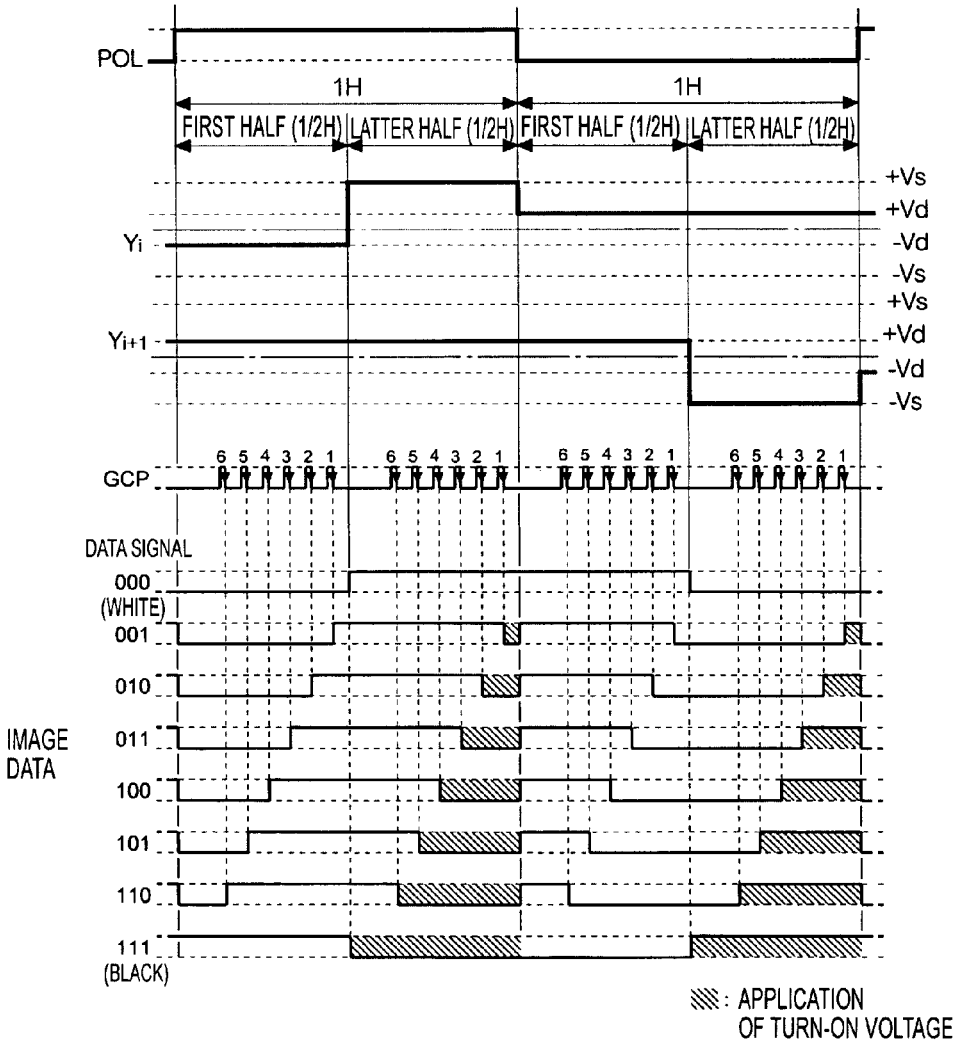
FIG. 4 is a timing chart, describing the operation of a data line driving circuit.

As shown in FIG. 4, the gray-scale-controlling pulse GCP rises in accordance with the intermediate shades excluding white and black in both the first-half and the latter-half of one horizontal scanning period. The data line driving circuit 51 supplies positive voltage +Vd and negative voltage −Vd as data signals Xj to one row of pixels 31 corresponding to the scanning line 21 selected by the scanning line driving circuit 52 at a time ratio in accordance with the display information for each pixel 31. For example, referring to FIG. 4, when image data for the pixels 31 of the j-th row is [000], which represents white; that is, the pixels 31 are turned off for display, in the first-half of the horizontal scanning period during which a scanning line 21 corresponding to the pixels 31 is selected, the data signal Xj has voltage ±Vd with opposite polarity from that of the selected voltage ±Vs to be supplied in the latter-half of the horizontal scanning period, while the data signal Xj has voltage ±Vd with the same polarity as that of the selected voltage ±Vs in the latter-half of the horizontal scanning period. When image data for pixels 31 of the j-th row is [111], which represents black; that is, the pixels 31 are turned on for display, in the first-half of a horizontal scanning period during which a scanning line 21 corresponding to the pixels 31 is selected, the data signal Xj has voltage ±Vd with the same polarity as that of the selected voltage ±Vs to be supplied to the scanning line 21 in the latter-half of the horizontal scanning period, while the data signal Xj has voltage ±Vd with opposite polarity from that of the selected voltage ±Vs in the latter-half of the horizontal scanning period. When image data has an intermediate shade excluding white and black, that is, a gray shade specified by image data [001] or [110], the voltage for the data signal xj is switched from either positive voltage +Vd or negative voltage −Vd to opposite voltage when the gray-scale-controlling pulse GCP rises. At the beginning of the latter-half of a horizontal scanning period in which selected voltage ±Vs is supplied to a scanning line 21, the data signal Xj has voltage ±Vd with the same polarity as that of the selected voltage ±Vs, that is, the voltage ±Vd with polarity in accordance with the logic level of the polarity-directing signal POL. When a gray-scale-controlling pulse GCP corresponding to the image data rises, the polarity of the voltage ±Vd is reversed. In the latter-half of the horizontal scanning period, as the darkness of the shade for the pixel 31 is increased, the duration during which the data signal Xj has turn-on voltage ±Vd with opposite polarity from that of the selected voltage ±Vs is increased. The data signal Xj in the first-half of the horizontal scanning period has voltage with opposite polarity of that of voltage for the data signal Xj in the latter-half of the horizontal scanning period. With the aforementioned structure, when the selected voltage ±Vs is applied to the scanning line 21 in the latter-half of the selected horizontal scanning period, the TFDs 15 are turned on, and voltage in accordance with the data signal Xj supplied to the data line 11 is applied to the liquid crystal capacitors 33. During other periods than this period, the TFDs 15 are turned off and the voltage applied to the liquid crystal capacitors 33 is retained therein. The gray-scale-controlling pulse GCP is a signal for determining voltage to be applied to the liquid crystal capacitors 33 in accordance with the instructed shade. The shades of the pixels 31 corresponding to image data are determined in accordance with the position of the gray-scale-controlling pulse GCP on a time axis.

As described above, the driving controller 61 shown in FIG. 1 controls the liquid crystal device 100 in accordance with the parameters stored in the register 65. The register 65 stores a parameter for controlling gray scale (gray-scale-control parameter), a parameter for controlling driving of the pixels 31 (driving-control parameter), and a parameter for controlling manufacture information (manufacture-information-control parameter). The gray-scale-control parameter control gray-scale characteristics of the liquid crystal panel P, specifically gamma characteristics. The gray-scale-controlling pulse GCP is output to the data line driving circuit 51 at timing defined by the gray-scale-control parameter. The difference between shades of image data and the actual shades of the pixels 31 is adjusted by changing the gray-scale-control parameter. The manufacture-information-control parameter concerns various information regarding the liquid crystal panel P, such as a type or a lot number of the liquid crystal panel P.

The driving-control parameter concerns driving of the pixels 31. The driving-control parameter includes a parameter for the total number of the pixels 31 in the liquid crystal panel P or the total number of the scanning lines 21 and the data lines 11 and a parameter for voltage level of the selected voltage ±Vs and the voltage ±Vd for driving the pixels 31. The selected voltage ±Vs and the voltage ±Vd are collectively referred to as driving voltage hereinbelow. In accordance with the driving-control parameters stored in the register 65, the driving controller 61 controls the scanning line driving circuit 52, the data line driving circuit 51, and the power-supply circuit 75. More specifically, the driving controller 61 specifies the total number of horizontal scanning periods in a vertical scanning period in accordance with the driving-control parameter for the total number of pixels 31, for example. The driving controller 61 then generates various signals such as the clock signal YCK, the start pulse DY, and the polarity-directing signal POL in accordance with duration of the horizontal scanning period and the vertical scanning period and outputs these signals to the scanning line driving circuit 52 and the data line driving circuit 51. The driving controller 61 gives voltage level of the voltage ±Vs and the voltage ±Vd to the power-supply circuit 75 in accordance with the driving-control parameters. Therefore, the driving voltage supplied to the scanning line driving circuit 52 and the data line driving circuit 51 from the power-supply circuit 75 is adjusted to a voltage level in accordance with the driving-control parameters.

The liquid crystal device 100 can be used as a display for various kinds of electronic devices for different purposes or with different functions. If different liquid crystal devices need to be manufactured for different electronic devices, inevitably the manufacturing costs are greatly increased. For this reason, the liquid crystal device 100 of the present invention is made to be used for various kinds of electronic devices for different purposes or with different functions. Functions or display characteristics required for the liquid crystal device 100 in the electronic devices differ depending on the type or application of the electronic devices. For example, the total number of pixels 31 in the liquid crystal panel P and the driving voltage level differ depending on the type of the electronic device in which the liquid crystal device 100 is incorporated. In the liquid crystal device 100 of the present invention, selected common parameters are initially stored in the register 65 regardless of the type or application of the electronic device in which the liquid crystal device 100 is incorporated, and these parameters are modified in accordance with the type or application of the electronic device. The parameter controller 63 shown in FIG. 1 controls the parameters stored in the register 65. That is, the parameter controller 63 overwrites the initial values with values of the parameters in accordance with a command from the CPU 80 in the electronic device (referred to as a commanded value hereinbelow) onto the register 65. On the other hand, every time the CPU 80 in the electronic device inputs the reset signal RES, the parameters are initialized.

If the number of parameters required to be changed from the initial values to the commanded values in accordance with the type or application of the electronic device is large, the load on the CPU 80 may be increased. To decrease the load on the CPU 80, the liquid crystal device 100 of the present embodiment is provided with an electronically erasable and programmable read only memory or EEPROM 71 for storing values of specific parameters (referred to as specific values hereinbelow), as shown in FIG. 1. Alternatively, an on time PROM or OTP may be used instead of the EEPROM 71. Prior to the display operation by the liquid crystal device 100, the parameter controller 63 allows the register 65 to read the parameters stored in the EEPROM 71 to change the initial values to the specific values. This decreases the load on the CPU 80 when changing the initial values to the commanded values in the register 65. Depending on the type or application of the electronic device, the liquid crystal device 100 may be properly operated only with the initial values initially stored in the register 65 and the commanded values that overwrite the initial values in accordance with a command from the CPU 80. In this case, the liquid crystal device 100 does not include the EEPROM 71. As apparent from the above-description, regarding the types of value of the parameters stored in the register 65, the operation of the liquid crystal device 100 can be categorized into three: (1) proper display operation as a display for an electronic device (referred to as predetermined operation hereinbelow) is performed only with the initial values initially stored in the register 65 (2) the predetermined operation is performed with the initial values initially stored in the register 65 and the specific values that overwrite the initial values, and (3) the predetermined operation is performed with the initial values initially stored in the register 65, the commanded values that overwrite the initial values in accordance with a command from the CPU 80, and the specific values stored in the EEPROM 71 that overwrite the initial values.

According to the liquid crystal device 100 having the aforementioned composition, when the reset signal RES for halting display is input from the CPU 80, the controller 60 of the present embodiment performs a reset process for changing the parameters stored in the register 65 to the initial values. After the reset process is completed, a power-off-sequence process for applying a turn-off voltage to all the pixels 31 is performed. The operation of the liquid crystal device 100 when the reset signal RES is input is described hereinbelow for a case where the commanded values from the CPU 80 are not necessary to perform the predetermined operation, i.e., the aforementioned operations in (1) and (2), and for a case where the commanded values from the CPU 80 are required to perform the predetermined operation, i.e., the aforementioned operation in (3).

When the Predetermined Operation can be Performed without the Commanded Values from the CPU 80

Figure 5:
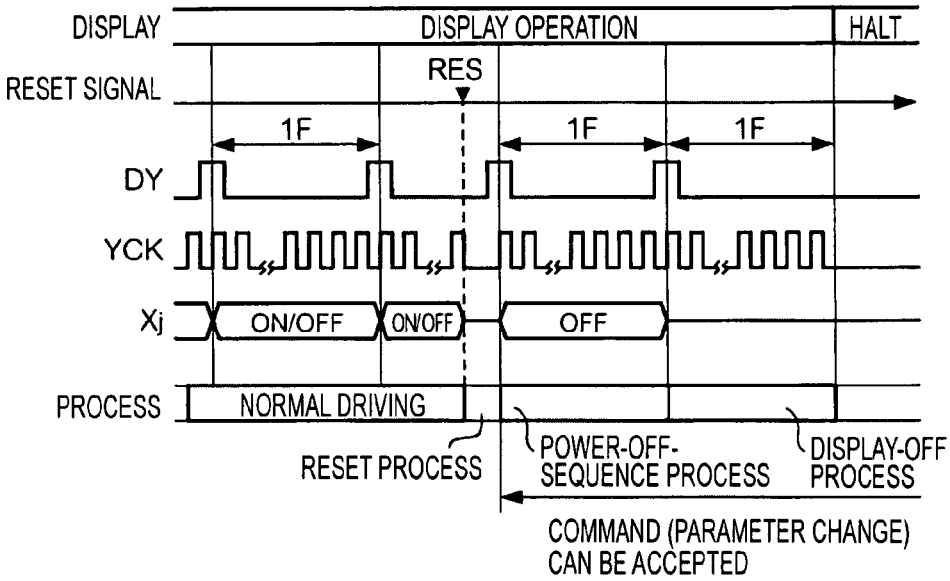
FIG. 5 is a timing chart, showing a time relationship between a reset process and a power-off-sequence process in a case where optimum driving is performed with parameters having initial values.

The case where the predetermined operation can be performed without the commanded values from the CPU 80 includes not only a case where the predetermined operation can be performed only with the initial values stored in the register 65 but also a case where the predetermined operation cannot be performed only with the initial values but can be performed by changing the initial values to the specific values stored in the EEPROM 71. As shown in FIG. 5, immediately after the reset signal RES is input, the reset process is performed. That is, when the parameter controller 63 detects an input of the reset signal RES, the parameter controller 63 changes the parameters stored in the register 65 to the initial values. When the EEPROM 71 is provided, the parameter controller 63 reads the specific values stored in the EEPROM 71 to overwrite the initial values with the specific values in the register 65. When the reset process is completed, the driving controller 61 controls the scanning line driving circuit 52 and the data line driving circuit 51 in order for the power-off-sequence process to be performed. That is, the reset process is performed prior to the power-off-sequence process. Accordingly, even when a command to change the parameters is input from the CPU 80 during the power-off-sequence process, the parameter change in accordance with the command is accepted and thus is reflected on the operation of the liquid crystal device 100. The power-off-sequence process is performed on optimum conditions in accordance with the initial values or specific values of the parameters. After the power-off-sequence process, a display-off process for sequentially scanning all the scanning lines 21 is performed in one vertical scanning period. After this process, display operation is halted and the liquid crystal device 100 goes into sleep mode.

Figure 6:
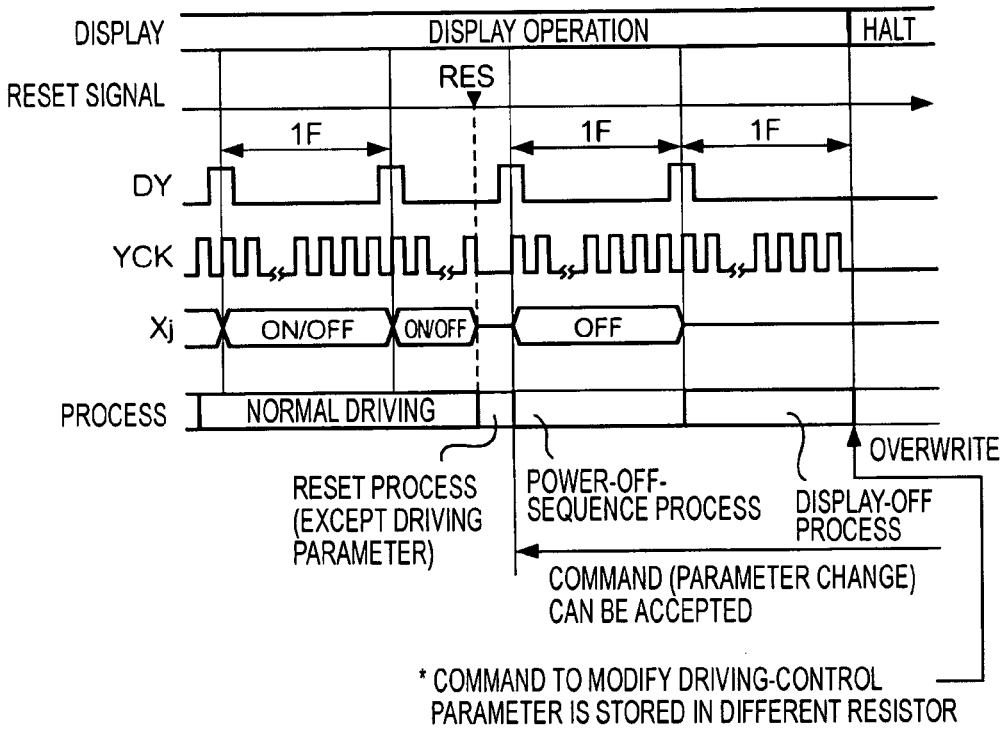
FIG. 6 is a timing chart, showing a time relationship between a reset process and a power-off-sequence in a case where optimum driving is not performed with parameters having initial values.

When the Commanded Values from the CPU 80 are Required to Perform the Predetermined Operation The case where the commanded values from the CPU 80 is required to perform the predetermined operation is that the predetermined operation cannot be performed only with the initial values stored in the register 65, and the initial values cannot also be changed to the specific values since the EEPROM 71 is not provided. In this case also, as shown in FIG. 6, immediately after the reset signal RES is input, the reset process is performed. In this reset process, however, not all the parameters stored in the register 65 are changed but the driving-control parameter remains the same; that is, the driving-control parameter is not changed, whereby the values for the driving-control parameter right before the reset process remain. Therefore, immediately after the reset process, the register 65 stores the driving-control parameter having the values immediately before the reset process and other parameters than the driving-control parameter, such as the gray-shade parameter or the manufacture-information-control parameter, having reset initial values. When the reset process is completed, the driving controller 61 controls the scanning line driving circuit 52 and the data line driving circuit 51 in order for the power-off-sequence process to be performed. Subsequently, the display-off process for sequentially scanning all the scanning lines 21 is performed in one vertical scanning period. Thereafter, the display operation is halted and thus the liquid crystal device 100 goes into sleep mode. The reset process is performed prior to the power-off-sequence process. Accordingly, command input during the power-off-sequence process or the display-off process can be reflected on the operation of the liquid crystal device 100. It should, however, be noted that the parameters can be changed during the power-off-sequence process or the display-off process are limited to the parameters except the driving-control parameter, such as the gray-scale-control parameter or the manufacture-information-control parameter. Hence, when a command to change the driving-control parameters is input from the CPU 80, the parameter controller 63 stores the requested values for the driving-control parameter in a register separated from the register 65. Then, when the display-off process is completed, the values for the driving-control parameter stored in the register overwrite the preset values stored in the register 65. In this structure, the power-off-sequence process is performed with the optimum driving-control parameter stored in the register 65 immediately before the reset process. Commands input during the power-off-sequence process or the display-off process from the CPU 80 can be reflected after the process.

The power-off-sequence process performed immediately after the reset process in (1) and (2) is a process to apply a turn-off voltage to all the pixels 31, as described above. More specifically, the first to the m-th scanning lines 21 are sequentially selected and a turn-off voltage, that is, a data signal Xj with image data [000] in FIG. 4, is supplied to n-pieces of the pixels 31 for the selected scanning lines 21 through the data lines 11. Accordingly, the driving controller 61 supplies image data [000], which represents white, to the data line driving circuit 51 for all the pixels 31.

Figure 7:
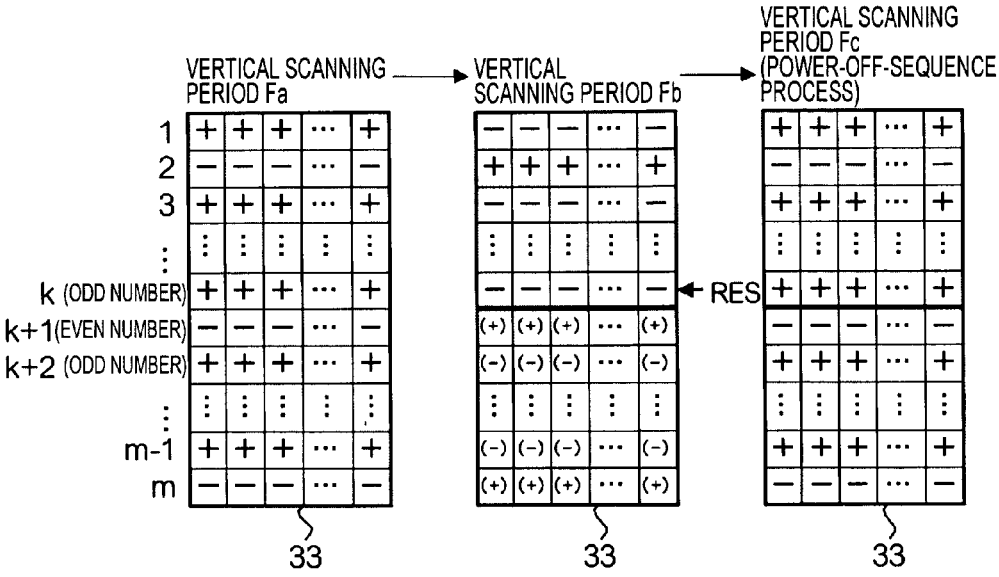
FIG. 7 is a schematic view, describing a problem that may occur in the power-off-sequence process.

A process to select the first to the m-th scanning lines 21 (referred to as vertical scanning below) in the power-off-sequence process may be vertical scanning for applying selected voltage such that the polarity of the selected voltage is alternately reversed for every scanning line 21 (the vertical scanning shown in FIG. 3), as in normal driving operation; that is, display operation except the power-off-sequence process. However, when this type of vertical scanning is performed in the power-off-sequence process after the reset process, electrical charge stored in the liquid crystal capacitors 33 cannot be sufficiently eliminated. Referring to FIG. 7, this problem is described in detail. In FIG. 7 and the following description, voltage retained in the liquid crystal capacitors 33 when the positive selected voltage +Vs is applied to the scanning line 21 has positive polarity (+), whereas voltage retained in the liquid crystal capacitors 33 when the negative selected voltage −Vs is applied to the scanning line 21 has negative polarity (−).

Referring to FIG. 7, the positive selected voltage +Vs is applied to odd-numbered scanning lines 21 and the negative selected voltage −Vs is applied to even-numbered scanning lines 21 during a vertical scanning period Fa. As shown in FIG. 7, voltage retained in the liquid crystal capacitors 33 of the pixels 31 for the odd-numbered scanning lines 21 has positive polarity (+), whereas voltage retained in the liquid crystal capacitors 33 of the pixels 31 for the even-numbered scanning lines 21 has negative polarity (−). In a vertical scanning period Fb following the vertical scanning period Fa, the polarity of the scanning signals Yi is reversed from that in the vertical scanning period Fa. That is, voltage retained in the liquid crystal capacitors 33 of the pixels 31 for the odd-numbered scanning lines 21 has negative polarity (−), whereas voltage retained in the liquid crystal capacitors 33 of the pixels 31 for the even-numbered scanning lines 21 has positive polarity (+) in the vertical scanning period Fb. Assuming that when negative selected voltage −Vs is applied to the k-th scanning line 21, which is an odd-numbered scanning line, in the vertical scanning period Fb, the reset signal RES is input. In this case, the (k+1)-th to the m-th scanning lines 21 are not selected in the vertical scanning period Fb. Immediately after the reset signal RES is input, the reset process is performed. When the reset process is completed, the power-off-sequence process is started, whereby vertical scanning is restarted from the first scanning line 21 in a vertical scanning period Fc. Assuming that the same vertical scanning as that performed in normal driving operation is performed in the power-off-sequence process in the vertical scanning period Fc, since polarities of the scanning signals in the vertical scanning period Fc are reversed from those in the vertical scanning period Fb, the liquid crystal capacitors 33 of the pixels 31 for the odd-numbered scanning lines has positive voltage, whereas the liquid crystal capacitors 33 of the pixels 31 for the even-numbered scanning lines has negative voltage. Considering the first to the k-th scanning lines 21 selected during the vertical scanning period Fc, voltage applied to the liquid crystal capacitors 33 of the pixels 31 for these scanning lines 21 has opposite polarity from that of voltage retained in the liquid crystal capacitors 33 in the vertical scanning period Fb preceding the vertical scanning period Fa and thus electric charge stored in these liquid crystal capacitors 33 is eliminated sufficiently. Now, consider the (k+1)-th to the m-th scanning lines 21, which should have been selected after the interruption of the vertical scanning in the vertical scanning period Fb. Since the (k+1)-th to the m-th scanning lines 21 are not selected in the vertical scanning period Fb, the liquid crystal capacitors 33 of the pixels 31 for the (k+1)-th to the m-th scanning lines 21 retain the voltage applied in the vertical scanning period Fa preceding the vertical scanning period Fb. More specifically, positive voltage is stored in the liquid crystal capacitors 33 for the odd-numbered scanning lines 21 out of the (k+1)-th to the m-th scanning lines 21, whereas negative voltage is stored in the liquid crystal capacitors 33 for the even-numbered scanning lines 21 out of the (k+1)-th to the m-th scanning lines 21. On the other hand, during the vertical scanning period Fc, as described above, positive selected voltage +Vs is applied to the odd-numbered scanning lines 21, whereas a negative selected voltage −Vs is applied to the even-numbered scanning lines 21. Accordingly, voltage having the same polarity is applied to the liquid crystal capacitors 33 for the (k+1)-th to the m-th scanning lines 21 over the vertical scanning periods Fa to Fc. Thus, electric charge retained in these liquid crystal capacitors 33 for the (k+1)-th to the m-th scanning lines 21 cannot be sufficiently eliminated.

To address the aforementioned problem, according to the present embodiment, vertical scanning is performed in the vertical scanning period Fc such that the polarity of the voltage applied to the liquid crystal capacitors 33 for the (k+1)-th to the m-th scanning lines 21 in the vertical scanning period Fc is reversed from that of the voltage stored in these liquid crystal capacitors 33 immediately before the vertical scanning period Fc. More specifically, voltage having opposite polarity from that of the vertical scanning period Fb is applied to the liquid crystal capacitors 33 for the first to the (k+1)-th scanning lines 21 in the vertical scanning period Fc, as in the normal driving operation described above. Voltage having opposite polarity from that of the voltage applied to the liquid crystal capacitors 33 for the (k+1)-th to the m-th scanning lines 21 in the vertical scanning period Fa is applied to the liquid crystal capacitors 33 for these scanning lines 21; that is, voltage having polarity that should have been applied to the liquid crystal capacitors 33 in the vertical scanning period Fb during which vertical scanning has been interrupted is applied to the liquid crystal capacitor 33 for the (k+1)-th to the m-th scanning lines 21. More specifically, referring to FIG. 8, voltage having positive polarity is applied to the liquid crystal capacitors 33 for the even-numbered scanning lines 21 out of the (k+1)-th to the m-th scanning lines 21, as in the liquid crystal capacitors 33 for the odd-numbered scanning lines 21 out of the first to the k-th scanning lines 21. By contrast, voltage having negative polarity is applied to the liquid crystal capacitors 33 for the odd-numbered scanning lines 21 out of the (k+1)-th to the m-th scanning lines 21, as in the liquid crystal capacitors 33 for the even-numbered scanning lines 21 out of the first to the k-th scanning lines 21. More specifically, the polarity of the voltage applied to the liquid crystal capacitors 33 in the vertical scanning during the vertical scanning period Fc is reversed at the boundary between the k-th scanning line 21, in which the vertical scanning has been interrupted during the vertical scanning period Fb, and the (k+1)-th scanning line 21, which should have been selected immediately after the k-th scanning line 21.

Figure 8:
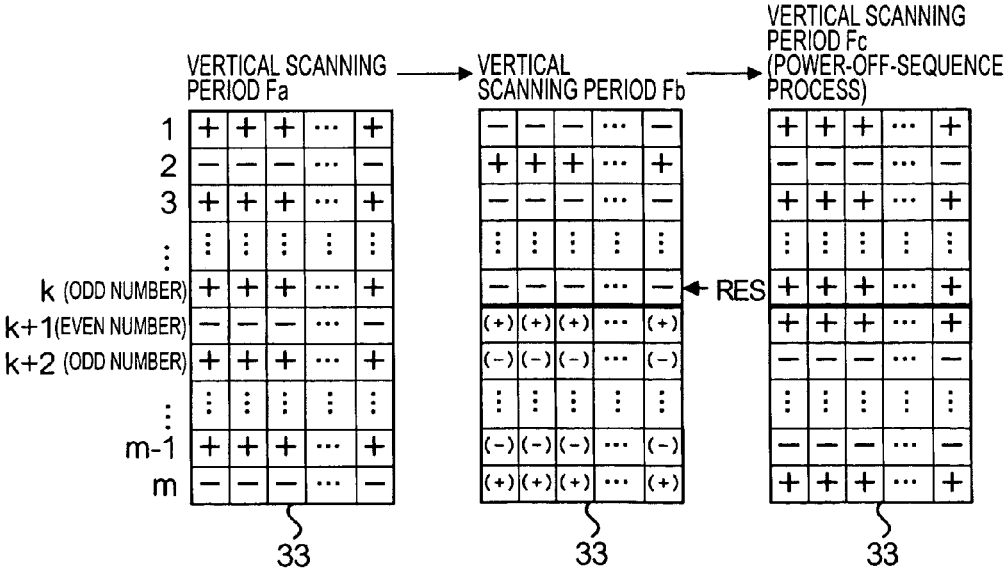
FIG. 8 is a schematic view, showing the polarity of voltage applied to liquid crystal capacitors in the power-off-sequence process of the present embodiment.
Figure 9:
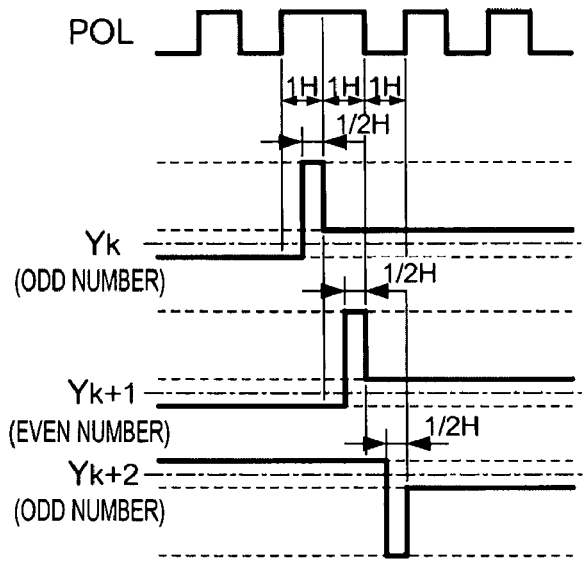
FIG. 9 is a timing chart, showing waveforms of scanning signals in the power-off-sequence process.

To perform the power-off-sequence process, the driving controller 61 of the present embodiment is provided with a function to specify a scanning line 21 selected when the reset signal RES is input. More specifically, the driving controller 61 has a counter for counting the clock signal YCK. When the start pulse DY rises, the counter resets a counted value. The counted value obtained by the counter corresponds to the number i for the scanning line 21 currently selected. The driving controller 61 stores the counted value obtained by the counter when the reset signal RES is input from the CPU 80 in the electronic device. In FIG. 8, the counted value K is stored in the register 65. The driving controller 61 acquires the counted value corresponding to the selected scanning line 21 during the vertical scanning period Fc in which the power-off-sequence is performed. When this counted value corresponds to the stored counted value, the correspondence between the logic level of the polarity-directing signal POL and even and odd numbers of the scanning lines 21 is reversed. That is, referring to FIG. 9, until the k-th scanning line 21 is selected, the polarity-directing signal POL takes an L-level in a horizontal scanning period in which an even-numbered scanning line 21 is selected, whereas the polarity-directing signal POL takes a high-level in a horizontal scanning period in which an odd-numbered scanning line 21 is selected. By contrast, for the (k+1)-th to the m-th scanning lines 21, the polarity-directing signal POL takes an H-level in a horizontal scanning period in which an even-numbered scanning line 21 is selected, whereas the polarity-directing signal POL takes a L-level in a horizontal scanning period in which an odd-numbered scanning line 21 is selected. Thus, as shown in FIGS. 8 and 9, positive selected voltage +Vs is applied to the k-th scanning line 21 and thus positive voltage is applied to the liquid crystal capacitors 33 for the k-th scanning line 21. On the other hand, positive selected voltage +Vs is applied to the (k+1)-th scanning line 21 and thus positive voltage is applied to the liquid crystal capacitors 33 for the (k+1)-th scanning line 21, while negative selected voltage −Vs is applied to the (k+2)-th scanning line 21 and thus negative voltage is applied to the liquid crystal capacitors 33 for the (k+2)-th scanning line 21. In the above description, the vertical scanning is interrupted when an odd-numbered scanning line 21 is selected. When vertical scanning is interrupted during selection of an even-numbered scanning line 21, voltage with opposite polarity from that of voltage that has been applied to the liquid crystal capacitors 33 immediately before the interruption is applied to these liquid crystal capacitors 33 in the power-off-sequence process.

According to the present embodiment, even when vertical scanning is interrupted, voltage with opposite polarity from that of the voltage that has been applied immediately before the interruption is applied to the liquid crystal capacitors 33 in the power-off-sequence process. Accordingly, electric charge in the liquid crystal capacitors 33 of all the pixels 31 can be sufficiently eliminated and thus deterioration of the liquid crystal 35 caused by application of direct voltage can be prevented.

Modification

Various modifications of the above-described present invention are possible and some of them are described below. These modifications may also be appropriately combined.

Although the controller 60, the scanning line driving circuit 52, and the data line driving circuit 51 are separate circuits in the above-embodiment, all of or part of these may be incorporated in a single IC chip. For example, an IC chip with the scanning line driving circuit 52 and an IC chip with the controller 60 and the data line driving circuit 51 can be mounted on the liquid crystal panel P. The positions of the controller 60, the scanning line driving circuit 52, and the data line driving circuit 51 on the liquid crystal panel P can be arbitrarily determined. Alternatively, all of or part of these circuits may be mounted on a flexible circuit board attached to the element board 10 or a printed circuit board connected to the flexible circuit board.

In the above embodiment, the TFDs 15 are connected to the data lines 11, and the scanning lines 21 are defined by the strip-shaped scanning lines 21 and the pixel electrodes 13. Alternatively, the TFDs 15 may be connected to the data lines 11, and the liquid crystal capacitors 33 may be defined by the strip-shaped data lines 11 and the pixel electrodes 13. Although the liquid crystal device 100 of the above embodiment is an active matrix liquid crystal display having the TFDs 15 serving as two-terminal switching devices, the present invention may be applied to an active matrix liquid crystal display utilizing thin film transistors (TFTs), which are three-terminal switching devices, or a passive matrix liquid crystal display without a switching device.

In the above embodiment, the selected voltage ±Vs is applied to the scanning lines 21 in the latter-half of the horizontal scanning period. Alternatively, the horizontal scanning period may not be divided. More specifically, while selected voltage ±Vs is applied to the scanning lines 21 during the entire horizontal scanning periods, voltage for the data signal Xj is switched from turn-on voltage to turn-off voltage and vice versa at timing in accordance with image data in all the horizontal scanning periods. Although pulse width modulation (PMW) driving in which the data signal Xj having a pulse width in accordance with image data is generated in the above embodiment, the data signal Xj having a signal level in accordance with image data may be generated. Furthermore, although the polarity of the scanning signal Yi is alternately reversed every horizontal scanning period and every vertical scanning period in the above embodiment, the polarity of the scanning signal Yi may be alternately reversed every group of horizontal scanning periods and every group of vertical scanning periods.

The polarity of voltage applied to the liquid crystal capacitors 33 in the power-off-sequence process is determined by adjusting the logic level of the polarity-directing signal POL in the above embodiment. The polarity of voltage applied to the liquid crystal capacitors 33 in the power-off-sequence process may be reversed from the polarity of voltage that has been applied immediately before in other ways. For example, positive selected voltage ±Vs and negative selected voltage −Vs supplied to the scanning line driving circuit 52 from the power-supply circuit 75 may be switched when a scanning line 21, which has not been selected by interruption in the vertical scanning period Fb preceding the vertical scanning period Fc, is selected in the vertical scanning period Fc in which the power-off-sequence is performed. Furthermore, although the scanning lines 21 are selected one-by-one in the power-off-sequence process in the above embodiment, a number of scanning lines 21, that is, two or m scanning lines 21, may be selected at a time to apply selected voltage. With this structure, time required for the power-off-sequence process is reduced as compared to the case where the scanning lines 21 are selected one-by-one.

Although in the above embodiment, the liquid crystal device 100 is exemplified as the electro-optical device of the present invention, the present invention may be applied to apparatuses utilizing electro-optical material other than liquid crystal. Electro-optical material is a material in which optical characteristics, such as transmittance or intensity of light, are changed when an electrical signal, i.e., a current signal or voltage signal is supplied. Examples of the apparatuses utilizing electro-optical material are a display apparatus using organic light-emitting diode (OLED), such as organic electroluminescent (EL) or light-emitting polymer, as electro-optical material, an electrophoretic display utilizing microcapsules containing colored liquid and white particles dispersed in the colored liquid as electro-optical material, a twisting ball display using twisting balls coated with different colors for sections having different polarities as electro-optical material, a toner display using black toner as electro-optical material, and a plasma display panel using high pressure gas, such as helium or neon, as electro-optical material.

Electronic Devices

Figure 10:
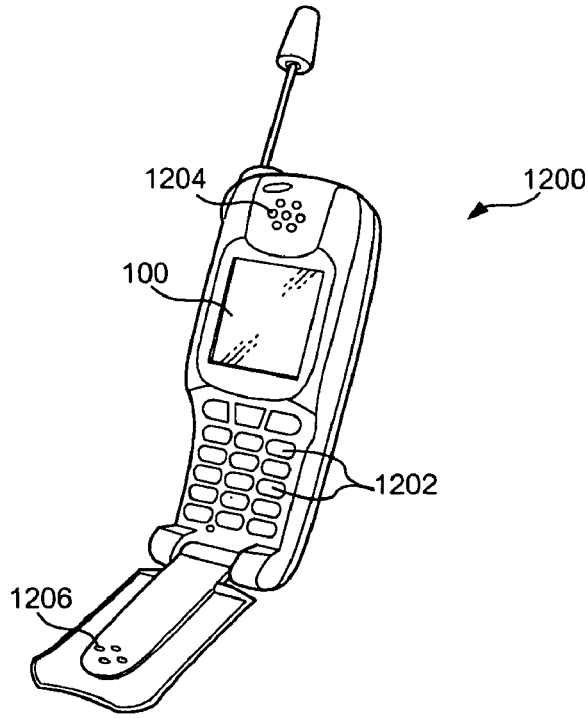
FIG. 10 is a perspective view of a cellular phone as an example of an electronic device according to the present invention.

Electronic devices including the electro-optical device of the present invention serving as a display will now be described. FIG. 10 is a perspective view of a cellular phone including the liquid crystal device 100 of the above-embodiment. A cellular phone 1200 includes a plurality of operating buttons 1202 to be operated by an user, a receiver 1204 for outputting voice transmitted from other terminal devices, a transmitter 1206 for inputting voice to be transmitted to other terminal devices, and the liquid crystal device 100 for displaying various images.

Electronic devices that can employ the electro-optical device of the present invention include a notebook personal computer, a liquid crystal display television, a viewfinder-type (direct-view-type) VCR, a car navigation system, a pager, an electronic notebook, a calculator, a word processor, a work station, a picture phone, a POS terminal, and devices furnished with touch panes, besides the cellular phone shown in FIG. 10.

What is claimed is:

1. A controller that controls an electro-optical device having:

a plurality of pixels aligned so as to correspond to each of the intersections of a plurality of scanning lines and a plurality of data lines, and a driving circuit that performs sequential vertical scanning of the selected plurality of scanning lines and applying data voltage to the pixels corresponding to the scanning lines in accordance with display information, the controller comprising:

a storage unit that stores a group of parameters including a driving-control parameter that controls the operation of the driving circuit;

an input unit that allows a command and a reset signal to be input, the command instructing a change in the group of parameters, the reset signal instructing display to halt;

a parameter controller that updates values of the group of parameters stored in the storage unit in accordance with the command when the command is input to the input unit and that initializes the values of the group of parameters stored in the storage unit when the reset signal is input to the input unit; and a driving controller that controls the driving circuit in accordance with the driving-control parameter stored in the storage unit, the driving controller controlling the driving circuit such that turn-off voltage is applied to the plurality of pixels after the parameter controller updates the values of the group of parameters by the input of the reset signal.

2. The controller according to claim 1, wherein the driving controller controls the driving circuit such that voltage applied to a first group of pixels out of the plurality of pixels has opposite polarity from the polarity of voltage applied to a second group of pixels that are different from the pixels in the first group, and the polarity of voltage applied to the pixels is alternately reversed for every predetermined period, wherein the driving controller controls the driving circuit such that when the reset signal is input to the input unit, vertical scanning being performed at the time of the input of the reset signal is interrupted and new vertical scanning is started from the first scanning line, and in the new vertical scanning, turn-off voltage with opposite polarity from voltage that has been applied to pixels corresponding to scanning lines selected before the interruption during the interrupted vertical scanning is applied to the pixels, while turn-off voltage with opposite polarity from voltage that has been applied to pixels in vertical scanning preceding the interrupted vertical scanning, the pixels corresponding to scanning lines that should have been selected after the interruption in the interrupted vertical scanning, is applied to the pixels.

3. An electro-optical device comprising a plurality of pixels aligned so as to correspond to each of the intersections of a plurality of scanning lines and a plurality of data lines;

a driving circuit that sequentially performs vertical scanning of the plurality of scanning lines and applying data voltage to pixels corresponding to the scanning lines in accordance with display information; and a controller as set forth in claim 1.

4. An electronic device comprising the electro-optical device as set forth in claim 3, the electro-optical device serving as a display.

5. A controller that controls an electro-optical device having:

a plurality of pixels aligned so as to correspond to each of the intersections of a plurality of scanning lines and a plurality of data lines, and a driving circuit that performs sequential vertical scanning of the selected plurality of scanning lines and applying data voltage to the pixels corresponding to the scanning lines in accordance with display information, the controller comprising:

a storage unit that stores a group of parameters including a driving-control parameter that controls the operation of the driving circuit;

an input unit that allows a command and a reset signal to be input, the command instructing a change in the group of parameters, the reset signal instructing display to halt;

a parameter controller that updates values of the group of parameters stored in the storage unit in accordance with the command when the command is input to the input unit and that initializes the values of the group of parameters stored in the storage unit except the driving-control parameter when the reset signal is input to the input unit; and a driving controller that controls the driving circuit in accordance with the driving-control parameter stored in the storage unit such that turn-off voltage is applied to the plurality of pixels after the parameter controller updates the values of the group of parameters by the input of the reset signal.

6. The controller according to claim 5, wherein the driving controller controls the driving circuit such that voltage applied to a first group of pixels out of the plurality of pixels has opposite polarity from the polarity of voltage applied to a second group of pixels that are different from the pixels in the first group, and the polarity of voltage applied to the pixels is alternately reversed for every predetermined period, wherein the driving controller controls the driving circuit such that when the reset signal is input to the input unit, vertical scanning being performed at the time of the input of the reset signal is interrupted and new vertical scanning is started from the first scanning line, and in the new vertical scanning, turn-off voltage with opposite polarity from voltage that has been applied to pixels corresponding to scanning lines selected before the interruption during the interrupted vertical scanning is applied to the pixels, while turn-off voltage with opposite polarity from voltage that has been applied to pixels in vertical scanning preceding the interrupted vertical scanning, the pixels corresponding to scanning lines that should have been selected after the interruption in the interrupted vertical scanning, is applied to the pixels.

7. An electro-optical device comprising a plurality of pixels aligned so as to correspond to each of the intersections of a plurality of scanning lines and a plurality of data lines;

a driving circuit that sequentially performs vertical scanning of the plurality of scanning lines and applying data voltage to pixels corresponding to the scanning lines in accordance with display information; and a controller as set forth in claim 5.

8. An electronic device comprising the electro-optical device as set forth in claim 7, the electro-optical device serving as a display.

9. A controller that controls an electro-optical device having:

a plurality of pixels aligned so as to correspond to each of the intersections of a plurality of scanning lines and a plurality of data lines, and a driving circuit that performs sequential vertical scanning of the selected plurality of scanning lines and applying data voltage to the pixels corresponding to the scanning lines in accordance with display information, the controller comprising:

an input unit that inputs a reset signal instructing display to halt; and a driving controller that controls the driving circuit to apply voltage to a first group of pixels out of the plurality of pixels has opposite polarity from the polarity of voltage applied to a second group of pixels that are different from the pixels in the first group, and the polarity of voltage applied to the pixels is alternately reversed for every predetermined period, and such that when the reset signal is input to the input unit, vertical scanning being performed at the time of the input of the reset signal is interrupted and new vertical scanning is started from the first scanning line, and in the new vertical scanning, turn-off voltage with opposite polarity from voltage that has been applied to pixels corresponding to scanning lines selected before the interruption during the interrupted vertical scanning is applied to the pixels, while turn-off voltage with opposite polarity from voltage that has been applied to pixels, which correspond to scanning lines that should have been selected after the interruption in the interrupted vertical scanning, in vertical scanning preceding the interrupted vertical scanning is applied to the pixels.

10. An electro-optical device comprising a plurality of pixels aligned so as to correspond to each of the intersections of a plurality of scanning lines and a plurality of data lines;

a driving circuit that sequentially performs vertical scanning of the plurality of scanning lines and applying data voltage to pixels corresponding to the scanning lines in accordance with display information; and a controller as set forth in claim 9.

11. An electronic device comprising the electro-optical device as set forth in claim 10, the electro-optical device serving as a display.

12. A method that controls an electro-optical device including a plurality of pixels aligned so as to correspond to each of the intersections of a plurality of scanning lines and a plurality of data lines, and a driving circuit that performs sequential vertical scanning of the selected plurality of scanning lines and that applies data voltage to the pixels corresponding to the scanning lines in accordance with display information, the method comprising the steps of:

updating values of a group of parameters stored in the storage unit when a command that controls the operation of the driving circuit and changing a group of parameters including a driving-control parameter is input to the input unit in accordance with the command, and initializing the values of the group of parameters stored in the storage unit when the reset signal that instructs display to halt is input; and controlling the driving circuit in accordance with the driving-control parameter stored in the storage unit such that turn-off voltage is applied to the plurality of pixels after the values of the group of parameters are updated by the input of the reset signal.

13. A method that controls an electro-optical device including a plurality of pixels aligned so as to correspond to each of the intersections of a plurality of scanning lines and a plurality of data lines, and a driving circuit that performs sequential vertical scanning of the selected plurality of scanning lines and applying data voltage to the pixels corresponding to the scanning lines in accordance with display information, the method comprising the steps of:

updating values of a group of parameters stored in a storage unit when a command that controls the operation of the driving circuit and changing the group of parameters including a driving-control parameter is input to the input unit in accordance with the command;

initializing the values of the group of parameters stored in the storage unit except the driving-control parameter when the reset signal that instructs display to halt is input; and controlling the driving circuit in accordance with the driving-control parameter stored in the storage unit and controlling the driving circuit such that turn-off voltage is applied to the plurality of pixels after the values of the group of parameters are updated by the input of the reset signal.

14. A method that controls an electro-optical device including a plurality of pixels aligned so as to correspond to each of the intersections of a plurality of scanning lines and a plurality of data lines, and a driving circuit that performs sequential vertical scanning of the selected plurality of scanning lines and applying data voltage to the pixels corresponding to the scanning lines in accordance with display information, the method comprising a step of controlling the driving circuit such that voltage applied to a first group of pixels out of the plurality of pixels has opposite polarity from the polarity of voltage applied to a second group of pixels that are different from the pixels in the first group, and the polarity of voltage applied to the pixels is alternately reversed for every predetermined period and such that when the reset signal that instructs display to halt is input to the input unit, vertical scanning being performed at the time of the input of the reset signal is interrupted and new vertical scanning is started from the first scanning line, and in the new vertical scanning, turn-off voltage with opposite polarity from voltage that has been applied to pixels corresponding to scanning lines selected before the interruption during the interrupted vertical scanning is applied to the pixels, while turn-off voltage with opposite polarity from voltage that has been applied to pixels in vertical scanning preceding the interrupted vertical scanning, the pixels corresponding to scanning lines that should have been selected after the interruption in the interrupted vertical scanning, is applied to the pixels.

* * * * *